US006474095B1

(12) United States Patent
Chan

(10) Patent No.: US 6,474,095 B1
(45) Date of Patent: Nov. 5, 2002

(54) COLLAPSIBLE CONTAINER

(75) Inventor: Chik Sum Chan, Shatin (HK)

(73) Assignee: Kado Industrial Co., Ltd. (HK)

( * ) Notice: Subject to any disclaimer, the term of this patent is extended or adjusted under 35 U.S.C. 154(b) by 0 days.

(21) Appl. No.: 09/977,967

(22) Filed: Oct. 17, 2001

(51) Int. Cl.[7] ..... F25D 3/08
(52) U.S. Cl. ..... 62/457.2; 62/530; 62/457.7
(58) Field of Search ..... 62/457.7, 530, 62/457.2

(56) References Cited

U.S. PATENT DOCUMENTS 4,050,264 A * 9/1977 Tanaka ..... 62/457
5,005,374 A * 4/1991 Spitler ..... 62/259.3
5,140,833 A * 8/1992 Whalen ..... 62/457.7
5,490,396 A * 2/1996 Morris ..... 62/457.2
5,533,361 A * 7/1996 Halpern ..... 62/457.2
5,562,228 A * 10/1996 Ericson ..... 220/415
6,164,526 A * 12/2000 Dalvey ..... 229/101
6,276,164 B1 * 8/2001 Santa Cruz et al. ..... 62/457.7
6,336,342 B1 * 1/2002 Zeddies ..... 62/457.2

* cited by examiner

*Primary Examiner*—William C. Doerrler
*Assistant Examiner*—Mark Shulman
(74) *Attorney, Agent, or Firm*—Burns Doane Swecker & Mathis, LLP

(57) ABSTRACT

A collapsible container is disclosed as having a number of walls which are movable relative to one another between a collapsed configuration in which at least a major surface of at least two of the walls are in contact with each other, and an expanded configuration in which the walls define a cavity adapted to receive an article, e.g. cans or bottles of soft drinks and beers, and the walls contain a casing containing saline water.

10 Claims, 6 Drawing Sheets

COLLAPSIBLE CONTAINER

This invention relates to a collapsible container, and, in particular, such a container which is adapted to be cooled to a low temperature, for the purpose of keeping contents in the container at a low temperature.

BACKGROUND OF THE INVENTION

There are in existence containers which are designed for keeping the contents cold. A conventional container includes a casing made of a plastics material, in which ice may be placed for keeping the contents, e.g. soft drinks or beers, at a low temperature, e.g. below 10° C. In order to enhance the insulating function of the container, the casing may have a vacuum layer or a layer of air trapped between an outer plastics wall and an inner plastics wall. A shortcoming of such a container is that the contents in the container may be damaged or ruined when the ice melts to liquid water.

In another conventional arrangement, instead of ice, one or more reusable coolable components are provided. When not in use, the coolable components are placed in a refrigerator so as to be brought to a low temperature, e.g. about or below 0° C. When required, the coolable components are retrieved from the refrigerators and placed in a container for keeping the contents therein at a low temperature. Such an arrangement suffers from the problem that the coolable components (which act as the cooling component when placed in the container) are separate from the container, and is thus not convenient in use. In addition, the coolable components usually contain chemicals which may be brought to a low temperature. Such chemicals may include toxic ingredients. Breaking of the coolable components may thus pose a danger to the users.

It is thus an object of the present invention to provide a container in which the aforesaid shortcomings are mitigated.

It is also an object of the present invention to provide a container which is compact and convenient to use, and can keep contents at a low temperature for a significant period of time.

It is a further object of the present invention to provide a container which is safe to use, and will not pose any risk to the users.

SUMMARY OF THE INVENTION

According to the present invention, there is provided a collapsible container with a plurality of wall members, wherein said wall members are movable relative to one another between a collapsed configuration in which at least a respective major surface of at least two said wall members are in contact with each other, and an expanded configuration in which said wall members define a cavity adapted to receive an article, wherein at least one said wall member contains a coolable agent.

BRIEF DESCRIPTION OF THE DRAWINGS

A preferred embodiment of the present invention will be described, by way of example only, and with reference to the accompanying drawings, in which.

DETAILED DESCRIPTION OF THE PREFERRED EMBODIMENT

Figure 1A:
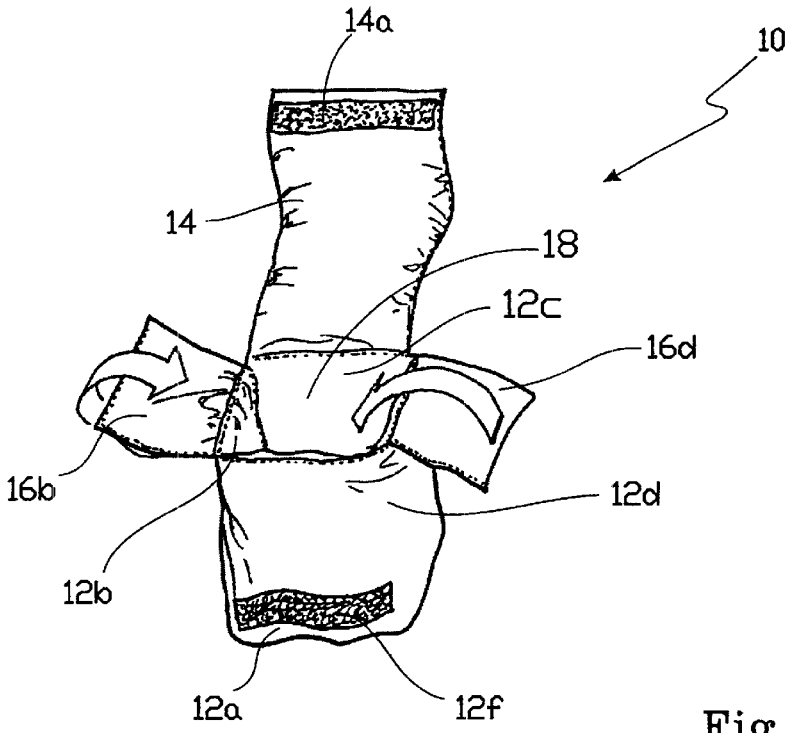
FIGS. 1A to 1G show the procedure whereby a collapsible container according to the present invention may be moved from an expanded configuration to a collapsed configuration.

A collapsible container according to a preferred embodiment of the present invention is shown in FIG. 1A in a fully expanded configuration, and generally designated as 10.

Figure 2:
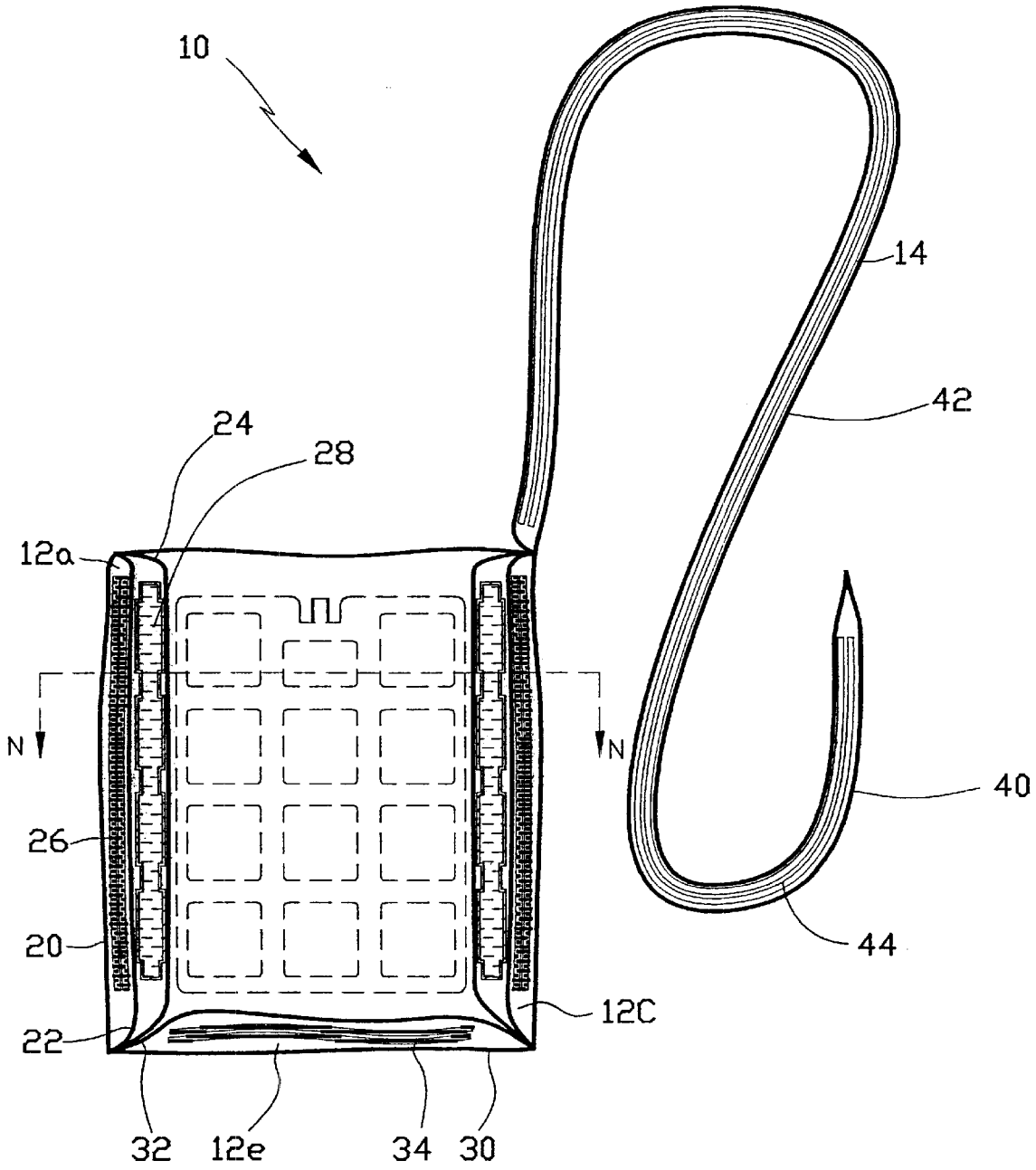
FIG. 2 shows a longitudinal sectional view of the container shown in FIG. 1A.

As can be seen in FIG. 1A, the container 10, when in the fully expanded configuration, includes four upstanding side walls 12*a*, 12*b*, 12*c*, 12*d* joined with one another, and with their lower ends joined with a bottom wall 12*e* (see FIG. 2). When at the expanded configuration, the side walls 12*a* and 12*c* are opposite to each other, and the side walls 12*b* and 12*d* are opposite to each other. Joined with the upper end of the side wall 12*c* is a longer top flap 14. Joined with the upper end of each of the side walls 12*b*, 12*d* is a respective shorter side flap 16*b*, 16*d*. The longer top flap 14 is soft and is movable about the rest of the container 10 about where it is joined with the side wall 12*c*. The shorter side flap 16*b* is soft and is movable about the rest of the container 10 about where it is joined with the side wall 12*b*. Similarly, the shorter side flap 16*d* is soft and is movable about the rest of the container 10 about where it is joined with the side wall 12*d*.

When in the expanded configuration, the walls 12*a*, 12*b*, 12*c*, 12*d* and 12*e* collectively define a cavity 18 suitable for receiving such contents as cans or bottles of soft drinks or beers. The two side flaps 16*b*, 16*d* may then be folded inwardly, in the direction indicated by the two arrows in FIG. 1A, to cover the cavity 18 from above. The top flap 14 may then be folded downwardly so that a releasable engagement mechanism 14*a*, e.g. one traded under the trade mark VELCRO sewn on an inner surface of the top flap 14 bears on and releasably engages with a similar engagement mechanism 12*f* sewn on an outer surface of the side wall 12*a*. Because of the materials with which the container 10 is made and other structures to be discussed below, the contents in the cavity 18 of the container 10 may be kept at a low temperature for a significant period of time.

Figure 1B:
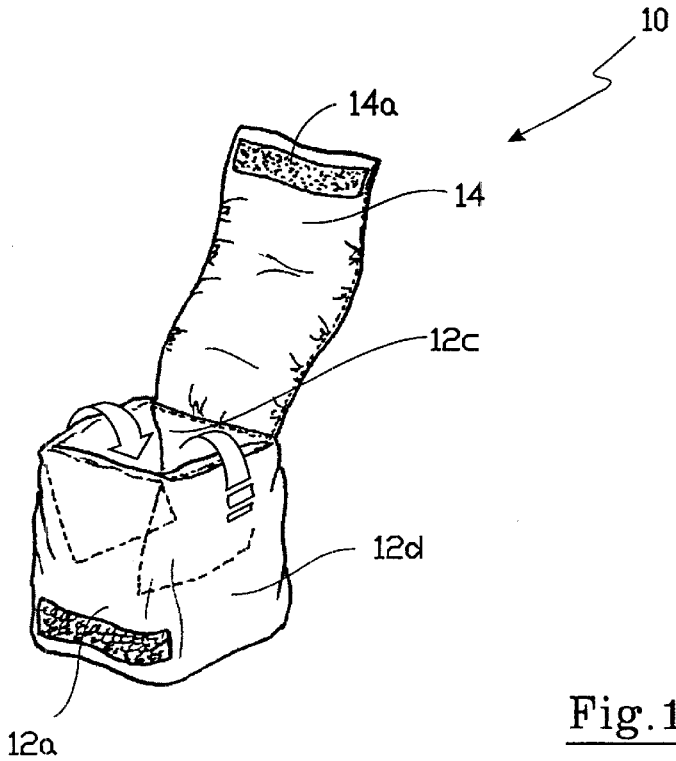
Figure 1C:
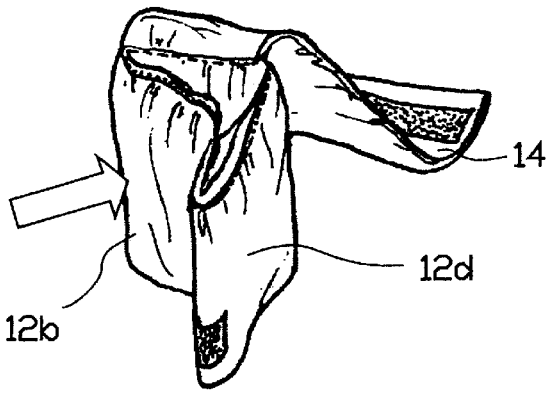
Figure 1D:
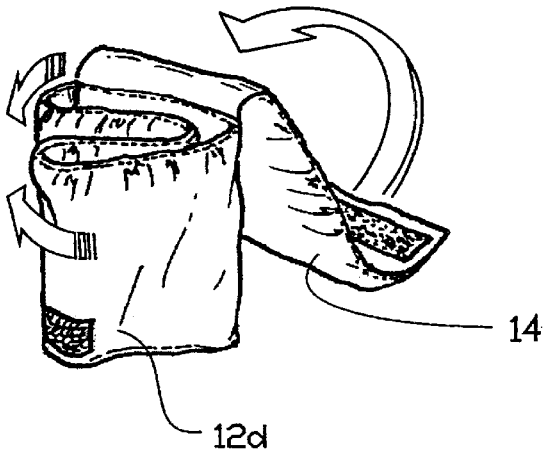

To convert the container 10 to the collapsed configuration, the two side flaps 16*b*, 16*d* are folded further downwardly, as shown by the two arrows in FIG. 1B, to bear on the inner surface of the side walls 12*b*, 12*d*. The side walls 12*a*, 12*b* are pushed inwardly, in the direction indicated by the arrow in FIG. 1C, and at the same time the side walls 12*c*, 12*d* are folded towards each other, in the direction of the two smaller arrows in FIG. 1D, until the inner surface of the side wall 12*b* contacts and bears on the inner surface of the side wall 12*c*, and the inner surface of the side wall 12*a* contacts and bears on the inner surface of the side wall 12*d*.

Figure 1E:
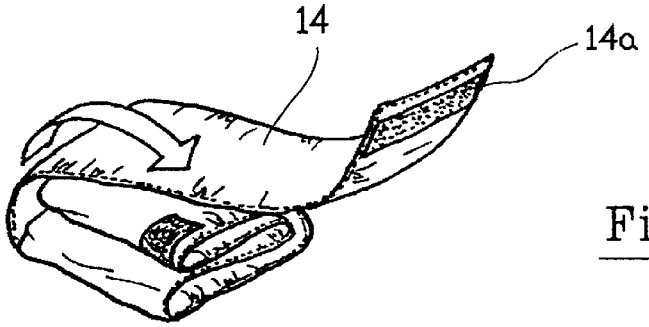
Figure 1F:
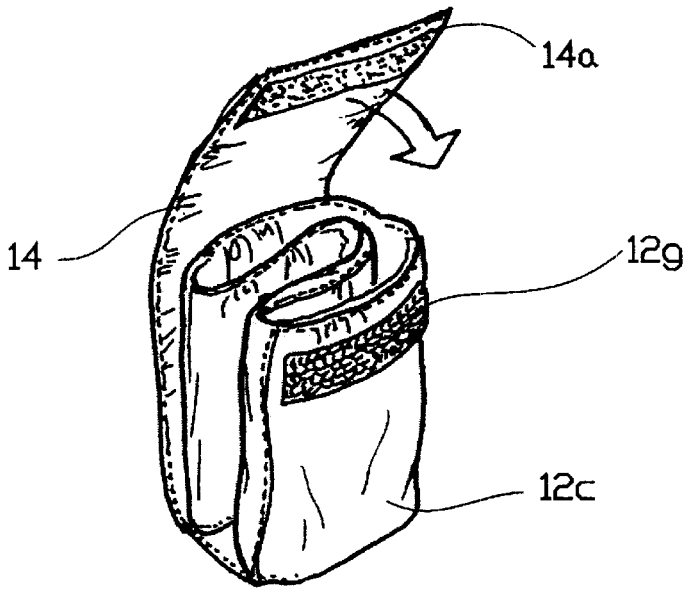
Figure 1G:
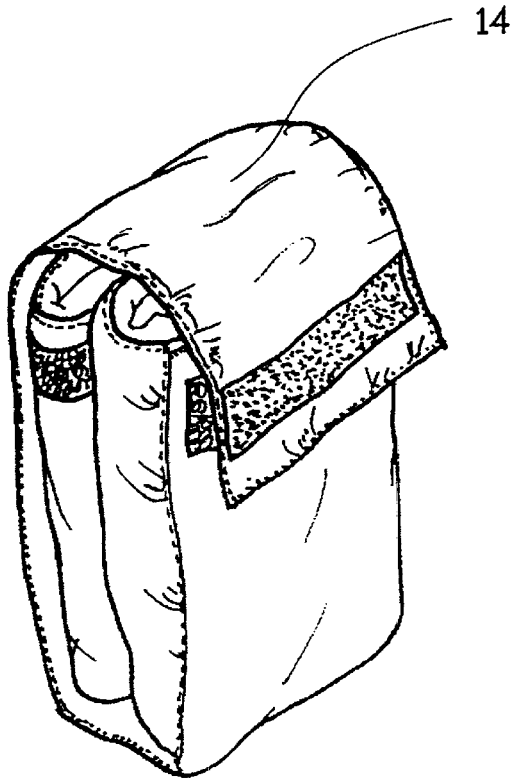

The top flap 14 is then wrapped around the side wall 12*d*,in the direction indicated by the arrow in FIG. 1E, through the configuration shown in FIG. 1F, until the releasable engagement mechanism 14*a* bears on and engages with a similar releasable engagement mechanism 12*g* sewn on an outer surface of the wall 12*c*, so as to bring the container 10 to the fully collapsed configuration, as shown in FIG. 1G. It can of course be seen that, by going through the steps in reverse, the container 10 may be moved from the fully collapsed configuration back to the expanded configuration.

Figure 3:
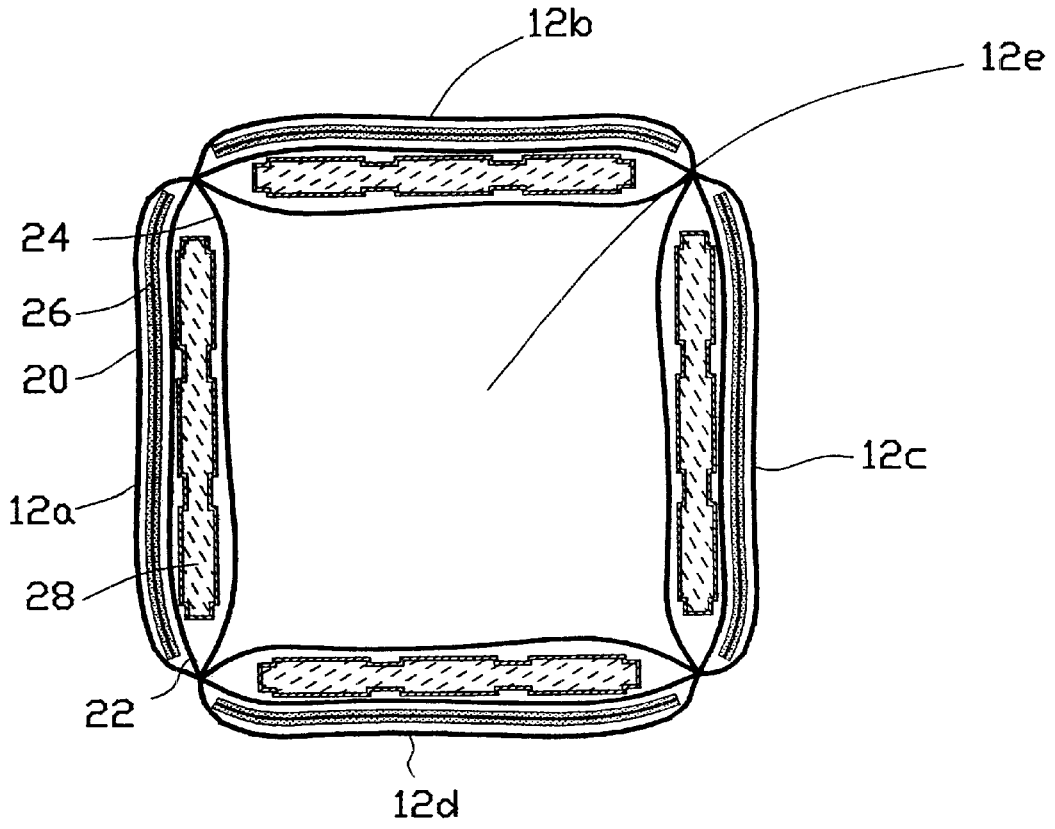
FIG. 3 shows a sectional view of the container taken along the line N—N in FIG. 2.

FIGS. 2 and 3 show, respectively, a longitudinal cross sectional view of the container 10, and a transverse sectional view of the container 10 taken along the line N—N in FIG.

2. As the structure of the side walls 12*a*, 12*b*, 12*c*, 12*d* is the same, only the structure of the side wall 12*a* will be discussed below. The side wall 12*a* has an outer layer of an air permeable material 20, e.g. a synthetic material traded under the trade name 10D OXFORD nylon a middle layer of an air impermeable material 22, e.g. a synthetic material traded under the trade name 10T coated nylon and an inner layer of an air permeable material 24, e.g. a synthetic material traded under the trade name 90T polyester Provided within a cavity between the outer layer of air permeable material 20 and the middle layer of air impermeable material 22 is a piece of sponge 26, which acts as an heat insulating material, of a thickness of around 5 mm. Provided within a cavity between the middle layer of air impermeable material 22 and the inner layer of air permeable material 24 is a casing 28, the function and structure of which will be discussed below.

As to the bottom wall 12*e*, such has an outer layer of an air permeable material 30, e.g. the synthetic material traded under the trade name 10D OXFORD nylon and an inner layer of an air impermeable material 32, e.g. the synthetic material traded under the trade name 10T coated nylon Provided within a cavity between the outer layer of air permeable material 30 and the inner layer of air impermeable material 32 is a piece of sponge 34, which acts as an heat insulating material, of a thickness of around 5 mm. An additional layer of an air permeable material, e.g. the synthetic material traded under the trade name 10D OXFORD nylon may be provided on top of the inner layer of air impermeable material 32.

Turning to the top flap 14, such has an outer layer of an air permeable material 40, e.g. the synthetic material traded under the trade name 10D OXFORD nylon and an inner layer of an air impermeable material 42, e.g. the synthetic material traded under the trade name 10T coated nylon Provided within a cavity between the layer of air permeable material 40 and the layer of air impermeable material 42 is a piece of sponge 44, which acts as a heat insulating material, of a thickness of around 5 mm. The side flaps 16*b*, 16*d* are of the same structure and made of the same materials as the top flap 14.

Figure 4A:
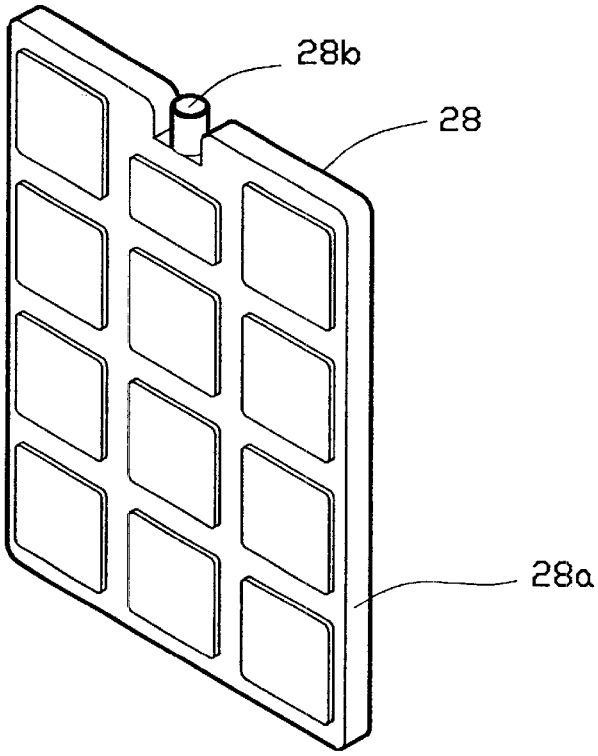
FIG. 4A shows a perspective view of the casing shown in FIG. 2 for containing cooling agent.
Figure 4B:
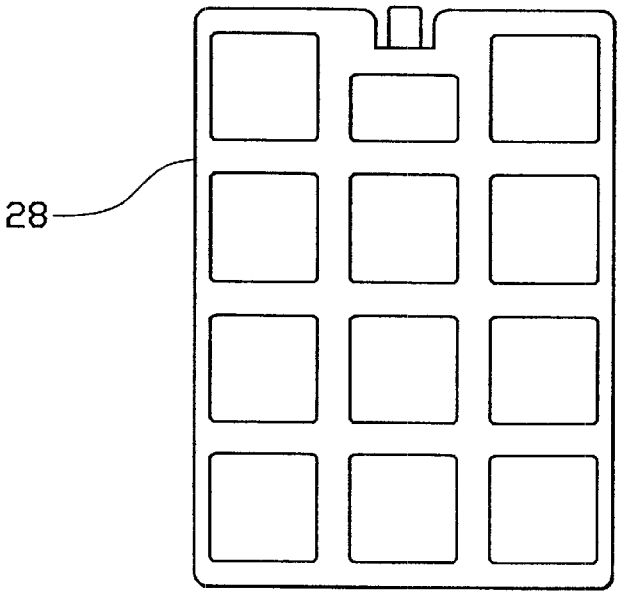
FIG. 4B shows a front view of the casing shown in FIG. 4A.
Figure 4C:
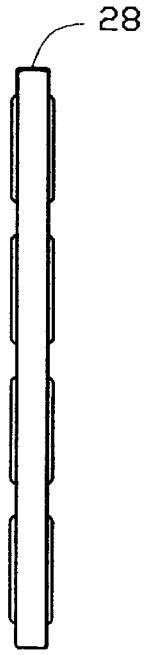
FIG. 4C shows a side view of the casing shown in FIG. 4A.

The casing 28 is shown in more details in FIGS. 4A to 4C. The casing 28 has a body 28*a* made of a plastic material, e.g. polyurethane. The body 28*a* has a mouth (not shown) to which a cap 28*b* may be secured. The cap 28*b* may be made of such plastic material as polypropylene. Through the mouth, purified water and common salt (sodium chloride) may be added into the body 28*a* of the casing 28. Generally, the ratio of the weight of salt to the weight of purified water introduced into the body 28*a* is roughly 1 to 1000.

In the present invention, the casing 28, with salt and water inside, acts as both a coolable agent and a cooling agent. As the casing 28 is built in within the side walls 12*a*, 12*b*, 12*c*, 12*d* of the container 10, when the container 10 is moved to the collapsed configuration, it can be conveniently and easily placed within, e.g. the freezer of a refrigerator, so that the casing 28 and the saline water inside are brought to a low temperature, e.g. close to or below 0° C. Because the container 10 is compact and occupies only a small space when in the collapsed configuration, a large number of such collapsed containers 10 may be stored in a refrigerator.

When required, the container 10 is retrieved from the refrigerator, manipulated to assume the expanded configuration, so as to enable articles to be placed within the cavity 18 and thus stored within the container 10. By way of the arrangement discussed above, the container 10 is very effective in heat-insulating the contents in the cavity 18 from the ambient temperature, so that the container 10 can cool the contents in the cavity 18 down to a low temperature and/or maintain the contents in the cavity 18 at a low temperature.

It can be readily seen from the foregoing discussion that a collapsible container according to the present invention is convenient to use, since the coolable agent is built in with the container 10. In addition, since the cooling agent includes purified water and salt only, such would pose no danger to the user even if the casing 28 is broken.

It should be understood that the above only illustrates an example whereby the present invention may be carried out, and that various modifications and/or alterations may be made thereto without departing from the spirit of the invention. It should also be understood that certain features of the invention which are now, for brevity, described in the context of a single embodiment, may be provided separately or in any appropriate sub-combinations.

What is claimed is:

1. A collapsible container with a plurality of wall members, wherein said wall members are movable relative to one another between a collapsed configuration in which at least a respective major surface of at least two said wall members are in contact with each other, and an expanded configuration in which said wall members define a cavity adapted to receive an article, wherein at least one said wall member contains a coolable agent, and further including a respective flap joined with a respective edge of two said wall members which are opposite to each other when said wall members are in said expanded configuration.

2. A container according to claim 1 wherein said coolable agent comprises at least water and common salt.

3. A container according to claim 1 wherein said coolable agent is contained within a plastic housing.

4. A container according to claim 3 wherein said housing is made at least principally of polyurethane.

5. A container according to claim 1 wherein at least a flap is joined with an edge of one of said wall members and movable relative thereto.

6. A container according to claim 5 wherein a respective flap is joined with a respective edge of two said wall members which are opposite to each other when said wall members are in said expanded configuration.

7. A collapsible container with a plurality of wall members, wherein said wall members are movable relative to one another between a collapsed configuration in which at least a respective major surface of at least two said wall members are in contact with each other, and an expanded configuration in which said wall members define a cavity adapted to receive an article, wherein at least one said wall member contains a coolable agent and said at least one wall member includes an outer layer of an air permeable synthetic material, a middle layer of an air impermeable synthetic material, and an inner layer of an air permeable synthetic material.

8. A container according to claim 7 wherein said outer layer of air permeable synthetic material, said middle layer of air impermeable synthetic material, and said inner layer of air permeable synthetic material collectively define at least two cavities.

9. A container according to claim 8 wherein at least one of said two cavities contains said cooling agent, and at least one of said two cavities contains a heat insulating material.

10. A container according to claim 9 wherein said heat insulating material is sponge.

* * * * *